US011850207B1

(12) United States Patent
Rasmussen

(10) Patent No.: US 11,850,207 B1
(45) Date of Patent: Dec. 26, 2023

(54) ROLLATOR WITH LASHING ASSEMBLY AND METHODS OF USE THEREOF

(71) Applicant: Nicholas Ryan Rasmussen, Sun Prairie, WI (US)

(72) Inventor: Nicholas Ryan Rasmussen, Sun Prairie, WI (US)

( * ) Notice: Subject to any disclaimer, the term of this patent is extended or adjusted under 35 U.S.C. 154(b) by 67 days.

(21) Appl. No.: 17/566,629

(22) Filed: Dec. 30, 2021

Related U.S. Application Data

(60) Provisional application No. 63/132,950, filed on Dec. 31, 2020.

(51) Int. Cl.
*A61H 3/04* (2006.01)

(52) U.S. Cl.
CPC ..... *A61H 3/04* (2013.01); *A61H 2003/046* (2013.01); *A61H 2201/0161* (2013.01)

(58) Field of Classification Search
CPC ..... A61H 2201/0165; A61H 3/04
See application file for complete search history.

(56) References Cited

U.S. PATENT DOCUMENTS

| | | | | |
|---|---|---|---|---|
| 7,712,477 | B2 | 5/2010 | McCarthy | |
| 8,720,914 | B1 * | 5/2014 | Heath | A61H 3/008 280/87.021 |
| 8,746,265 | B2 * | 6/2014 | Nilsson | A61G 5/10 297/42 |
| 10,391,018 | B1 * | 8/2019 | Fitzwater | A61H 1/00 |
| 2007/0170699 | A1 * | 7/2007 | Li | A61H 3/04 280/304.1 |
| 2012/0048318 | A1 * | 3/2012 | Zendzian | A61H 3/04 297/423.39 |
| 2015/0075575 | A1 * | 3/2015 | Karlovich | A61N 1/0452 135/65 |
| 2018/0168910 | A1 * | 6/2018 | Threlfall | A61H 3/04 |
| 2020/0281801 | A1 * | 9/2020 | Karlovich | A63B 69/0064 |

(Continued)

FOREIGN PATENT DOCUMENTS

WO 2009154620 12/2009

OTHER PUBLICATIONS

Medline, Medline Standard Steel Folding Rollator Walker with 8" Wheels, Supports up to 350lbs, Blue, viewed at https://www.amazon.com/Medline-Standard-Folding-Rollator-Walker/dp/B00I6GQDU6?th=1 on Jan. 31, 2023. 10 pages. Indicated date of first availability: Feb. 1, 2014.

(Continued)

*Primary Examiner* — Erez Gurari
(74) *Attorney, Agent, or Firm* — Brannen Law Office, LLC

(57) ABSTRACT

A lashing assembly with straps is provided for use with rollators. A rollator has a body two sections. The first section has two legs each having a handle with brake lever at a first end and a wheel at a second end. The second section has two legs, each having a first end pivotally connected to a first section leg and a second end with a wheel and brake thereon. A hinge assembly having two side supports and a crossbar interconnect the first section and second section. The body can be in a folded position or a deployed position. The lashing assembly has a two straps each with a ring at one end and an optional handle at the other. The straps can be fastened with fasteners. The lashing assembly can secure the rollator in a folded position and can be used to hang the rollator from a hanger.

20 Claims, 18 Drawing Sheets

(56) References Cited

U.S. PATENT DOCUMENTS

| | | | | |
|---|---|---|---|---|
| 2020/0352816 | A1* | 11/2020 | Lu | A61H 3/04 |
| 2021/0402254 | A1* | 12/2021 | Briscoe | A63B 21/00181 |
| 2022/0202642 | A1* | 6/2022 | Lewis | A61H 3/008 |
| 2022/0211568 | A1* | 7/2022 | AlGhazi | A61B 5/1117 |
| 2023/0029427 | A1* | 1/2023 | Karlovich | A61G 5/043 |
| 2023/0119433 | A1* | 4/2023 | Gong | A61H 1/00 701/1 |

OTHER PUBLICATIONS

Probasics, 2016 Product Catalog, saved Nov. 22, 2020. 58 pages (rollators on pp. 10-15, 31).

Drive Medical, Two Wheeled Walker with Seat, viewed at https://www.drivemedical.com/us/en/products/mobility/walkers/two-button-walkers/two-wheeled-walker-with-seat/p/2719-1 on Nov. 22, 2020. 4 pages.

* cited by examiner

ROLLATOR WITH LASHING ASSEMBLY AND METHODS OF USE THEREOF

This United States utility patent application claims priority on and the benefit of provisional application 63/132,950 filed Dec. 31, 2020, the entire contents of which are hereby incorporated herein by reference.

BACKGROUND OF THE INVENTION

1. Field of the Invention

The present invention relates to a rollator with a lashing assembly having straps used to provide increased rollator functionality and the methods of use thereof.

2. Description of the Related Art

Rollators are very useful. Rollators are devices that aid in personal mobility, and usually have wheels and handles, which allow the user to gain stability while using the rollator to move about their environment. Many rollators can be folded from a deployed position to a storage position.

While the benefits of existing rollators are many, rollator functionality can nevertheless be improved.

One downside of existing rollators is that they can be cumbersome to transport and/or store. There is no way to secure existing folding rollators in a folded storage position. Because of this, the rollators have a tendency to unfold or reopen.

For example, unintended opening of the rollator can make loading and unloading the rollator from a vehicle both cumbersome and dangerous. It can lead to drops and being pinched.

Further, rollators can be challenging to store. Aside from the tendency to reopen, the rollators take up a lot of floor space.

Thus, there exists a need for rollator with lashing assembly and the methods of use thereof that solves these and other problems.

SUMMARY OF THE INVENTION

A lashing assembly with straps is provided for use with rollators. A rollator has a body two sections. The first section has two legs each having a handle with brake lever at a first end and a wheel at a second end. The second section has two legs, each having a first end pivotally connected to a first section leg and a second end with a wheel and brake thereon. A hinge assembly having two side supports and a crossbar interconnect the first section and second section. The body can be in a folded position or a deployed position. The lashing assembly has a two straps each with a ring at one end and an optional handle at the other. The straps can be fastened with fasteners. The lashing assembly can secure the rollator in a folded position and can be used to hang the rollator from a hanger.

According to one advantage of the present invention, the lashing assembly can secure or lock the rollator in the folded position. This can be accomplished by securing straps to the hinge assembly crossbar, wrapping the straps around the rear legs, fastening the straps together and shortening the effective length of the lashing assembly. This prevents the rollator from unfolding. This is advantageous when the rollator is free-standing in the folded position. This also assists when a user loads and unloads the rollator from a vehicle as preventing unintended unfolding can prevent drops and being pinched.

Related, the straps can be used to draw up crossbar of the hinge assembly to assist in folding the rollator. This is accomplished as wrapping the straps around the rear legs and drawing them up pulls the crossbar and rear legs together.

According to a further advantage of the present invention, the lashing assembly can be used with any folding rollator with a crossbar. Further, it can be used without making any modifications to the rollator. This can advantageously be accomplished by using rings at the ends of strap, and wrapping the straps around the crossbar and through the rings so that the strap end is anchored around the crossbar.

According to a still further advantage of the present invention, the straps can be used to secure loads. In one embodiment, the straps can secure a load atop the seat wherein the user can use the rollator as a movement aid while simultaneously transporting an object.

According to a still further advantage yet of the present invention, the straps have optional handles. The handles can be used by the user to have enhanced grip in shortening the lashing assembly effective length. Also, the straps can be used to suspend a folded and secured rollator from a hanger.

The strap fasteners can each be moved along the straps a similar amount wherein the fastener connection is made at or near the rollator center of gravity. This allows the hanger to be suspended in a vertical or near vertical orientation. This is not only aesthetically pleasing, but may also be easier for the user to use as they do not have to contend with shifting rollator weight.

According to another embodiment of the present invention a handle brake lock can be provided. The handle brake lock can be formed of a strap with two joinable fasteners between the ends. The fasteners can be joined together to form a loop on the band. The loop can have a selectably adjustable circumference. The brake strap can be used to hold the brake lock lever in the locked position. This advantageously provides stability to the rollator both in the unfolded and folded position.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
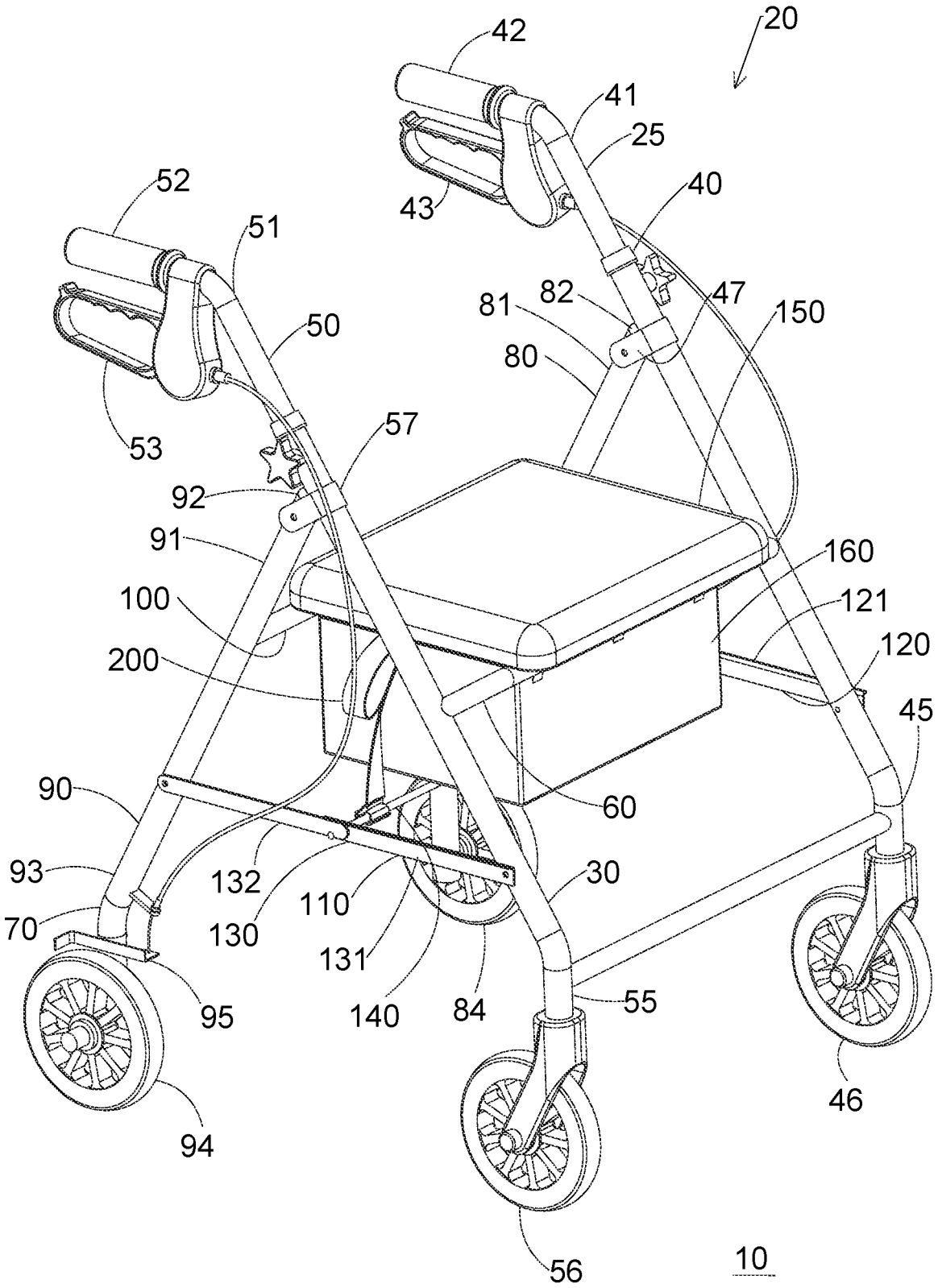
FIG. 1 is a side perspective view of an embodiment of the present invention in an unfolded position.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

The straps described below may be made of any suitable material, such as a polymer (propylene or nylon). Propylene is preferred due to better friction attributes. Yet, it is appreciated that other materials (such as but not limited to rubber, leather or fabric) may be used without departing from the broad aspects of the present invention.

An embodiment of a rollator 20 is illustrated in FIGS. 1-17. The rollator 20 has a body 25 with a first section 30 and a second section 70. The rollator 20 further has a hinge assembly 110, a seat 150, a storage compartment 160 and a lashing assembly 200.

The first section 30 has a first leg 40 with a first end 41 and a second end 45. A grip 42 and a brake lever 43 are at the first end 41 of the leg. A wheel 46 is at the second end 45 of the first leg 40. The wheel 46 can be a caster wheel that is swivelable relative to the end 45 of the leg 40. The first leg 40 has a pivot bar 47 with a pivot hole formed therein at a position between the ends. The first section 30 further has a second leg 50 with a first end 51 and a second end 55. A grip 52 and a brake lever 53 are at the first end 51 of the leg. A wheel 56 is at the second end 55 of the second leg 50. The wheel 56 can be a caster wheel that is swivelable relative to the end 55 of the leg 50. The second leg 40 has a pivot bar 57 with a pivot hole formed therein at a position between the ends. The wheels 46 and 56 allow the rollator to turn as directed by a user 5. A cross-member 100 interconnects the first and second legs 40 and 50, respectively.

The second section 70 has a first leg 80 and a second leg 90. The first leg 80 has a first end 81 with a bumper 82 thereon and a second end 83 with a wheel 84 and brake 85 thereon. The second leg 90 has a first end 91 with a bumper 92 thereon and a second end 93 with a wheel 94 and brake 95 thereon. A cross-member 100 interconnects the first and second legs 80 and 90, respectively.

Brake 85 is connected to brake lever 43 with a cable, wherein pulling the lever 43 causes the cable tension to increase to cause the brake 85 to engage the wheel 84. Similarly, brake 95 is connected to brake lever 53, wherein pulling the lever 53 causes the cable tension to increase to cause the brake 95 to engage the wheel 94.

The second section first leg 80 is pivotally connected to the first section first leg via pivot bar 47. The second section second leg 90 is pivotally connected to the first section second leg 50 via pivot bar 57.

A hinge assembly 110 is provided. The hinge assembly 110 has a first side support 120 with a first piece 121 and a second piece 122. The first and second pieces 121 and 122 are pivotally connected together. One of the pieces has a top lip to prevent the pieces from over-pivoting by contacting the top of the other piece when the rollator is fully deployed to the open position. The hinge assembly 110 has a second side support 130 with a first piece 131 and a second piece 132. The first and second pieces 131 and 132 are pivotally connected together. One of the pieces has a top lip to prevent the pieces from over-pivoting by contacting the top of the other piece when the rollator is fully deployed to the open position. Each side support is connected to the first section and second section. A crossbar 140 is provided and spans between side supports 120 and 130. The crossbar 140 is preferably parallel to cross-members 60 and 100.

Side support pieces 121 and 122 are preferably generally parallel when the rollator is in the deployed open position. Side support pieces are articulated to inclined orientations (highest point is where the side support pieces 121 and 122 connect to each other) when the rollator is in the folded or storage position. Side support pieces 131 and 132 are preferably generally parallel when the rollator is in the deployed open position. Side support pieces are articulated to inclined orientations (highest point is where the side support pieces 131 and 132 connect to each other) when the rollator is in the stored position.

Figure 2:
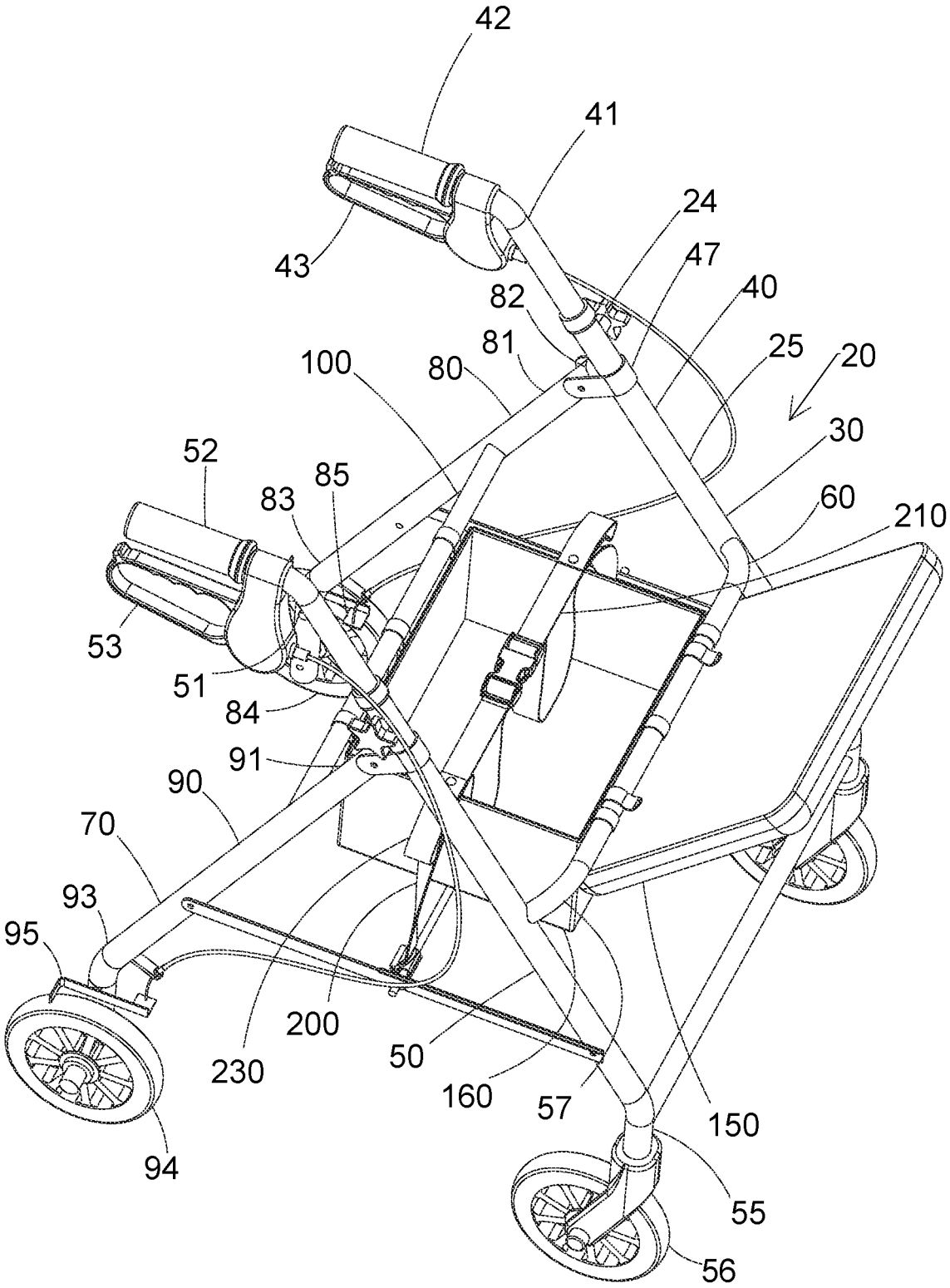
FIG. 2 is similar to FIG. 1 but shows the seat moved to a pivoted position to allow access to a storage compartment and showing the lashing assembly in a stowed position.

A seat 150 and a storage compartment 160 are also preferably provided. The seat 150 is preferably hingedly connected to cross-member 60. The seat can be flat and additionally be supported by cross-member 100 or can be flipped upright about cross-member 60 to allow access to a storage compartment 160. The storage compartment 160 is preferably a flexible compartment and is preferably supported by both cross-members 60 and 100. The interior of the compartment is illustrated in FIG. 2.

A lashing assembly 200 is best seen in FIGS. 1-17. The lashing assembly 200 has strap 210 and strap 230.

Figure 3:
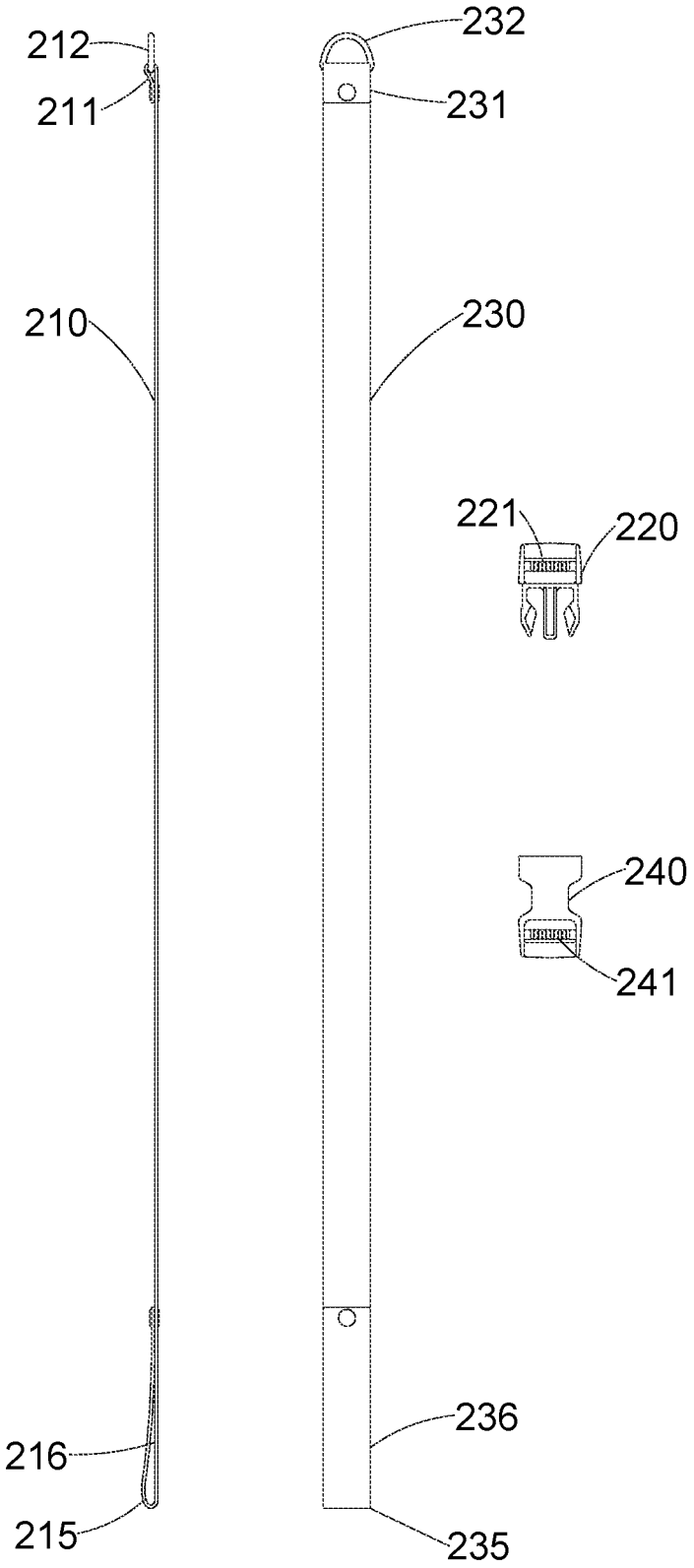
FIG. 3 is an isolation exploded view of the straps and fasteners of the lashing assembly.

Strap 210 has end 211 with a ring 212 affixed thereto. The ring 212 is preferably a D-ring. Yet, it appreciated that other shapes could be used without departing from the broad aspects of the present invention. The strap 210 has a second end 215 with an optional handle 216 formed therein. Handle 216 is preferably formed by folding the strap over to form a loop. A prong fastener 220 with a slot with bar 221 is provided. Strap 210 can be slidably looped through the slot around bar 221. Bar 221 preferably has ribbing as shown in FIG. 3.

Strap 230 has end 231 with a ring 232 affixed thereto. The ring 232 is preferably a D-ring. Yet, it appreciated that other shapes could be used without departing from the broad aspects of the present invention. The strap 230 has a second end 235 with an optional handle 236 formed therein. Handle 216 is preferably formed by folding the strap over to form a loop. A receiver fastener 240 with a slot with bar 241 is provided. Strap 230 can be slidably looped through the slot around bar 241. Bar 241 preferably has ribbing as shown in FIG. 3.

Together, fasteners 220 and 240 form a buckle.

The straps 210 and 230 are shown to be about 1 inch in width. Yet, it is preferred that other widths may be used without departing from the broad aspects of the present invention. An overall preferred length and width of the straps 210 and 230 are illustrated in FIG. 3.

Fasteners 220 and 240 can be removably connected to each other. This is accomplished by inserting prongs from the prong fastener 220 into cavities in the receiver fastener 240. The prongs temporarily deform when entering the fasteners and the resiliently spring to their unbiased position when fully received within the cavities. When connected to each other, the lashing assembly 200 has an effective length that is the length of the portion of the strap 210 between the crossbar 140 and the connected fasteners, the length of the connected fasteners, and the length of the strap 230 between the crossbar 140 and the connected fasteners. The effective length can be selectably be increased or decreased by the user. It is appreciated that while fasteners 220 and 240 are illustrated as a release buckle, that other user detachable fastener assemblies or buckles could be used without departing from the broad aspects of the present invention.

Further, there are alternative ways to achieve and maintain a desired lashing assembly effective length. For example, one or both straps could be self-retractable into a housing. This could be accomplished via a ratcheting or spring-loaded spooling mechanism that can housed on the buckle or crossbar.

The fastener's bars (buckle cross bars) can be oriented with respect to respective straps to allow the effective length of the lashing assembly to be shortened (when fasteners are connected together) but not easily allow the effective length to be elongated when the lashing assembly is under tension. When a bar of the buckle is perpendicular to a strap, the bar can directly engage the strap to increase frictional force between the strap and the bar to prevent movement in the direction causing lashing assembly effective length elongation. When under tension, the strap is allowed to further tighten as the bar does not prevent effective length shortening. Without tension, the bar can be rotated relative to the strap and the strap can easily move in either direction upon the fastener.

It is understood that the relation of fasteners 220 and 240 and corresponding straps 210 and 230 could be opposite of what is illustrated without departing from the broad aspects of the present invention.

Figure 4:
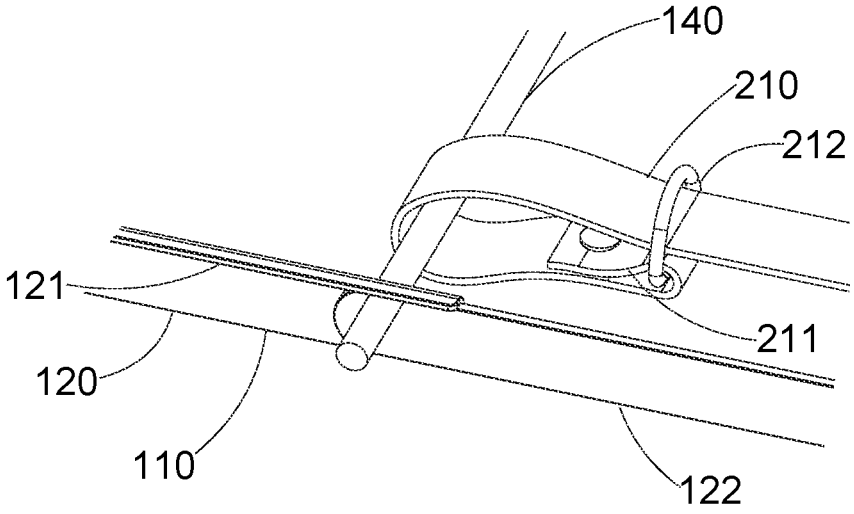
FIG. 4 is a close-up view of an end of a strap loosely wrapped about a crossbar.
Figure 5:
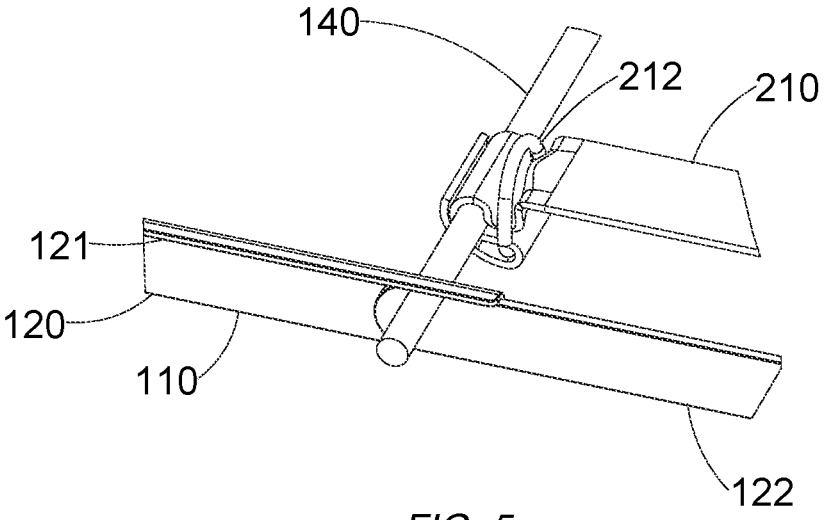
FIG. 5 is a similar to FIG. 4 but shows the end of the strap tightly wrapped about the crossbar.

Turning now to FIGS. 4 and 5, it is seen how the end of strap 210 is securing around the crossbar 140 near side support 120. This is accomplished as the opposite end (not shown in these figures) is passed through the ring 212 so that the created loop tightens around the crossbar.

It is appreciated that strap 230 is similarly connected to the opposite end of the crossbar 140 near side support 130.

Figure 6:
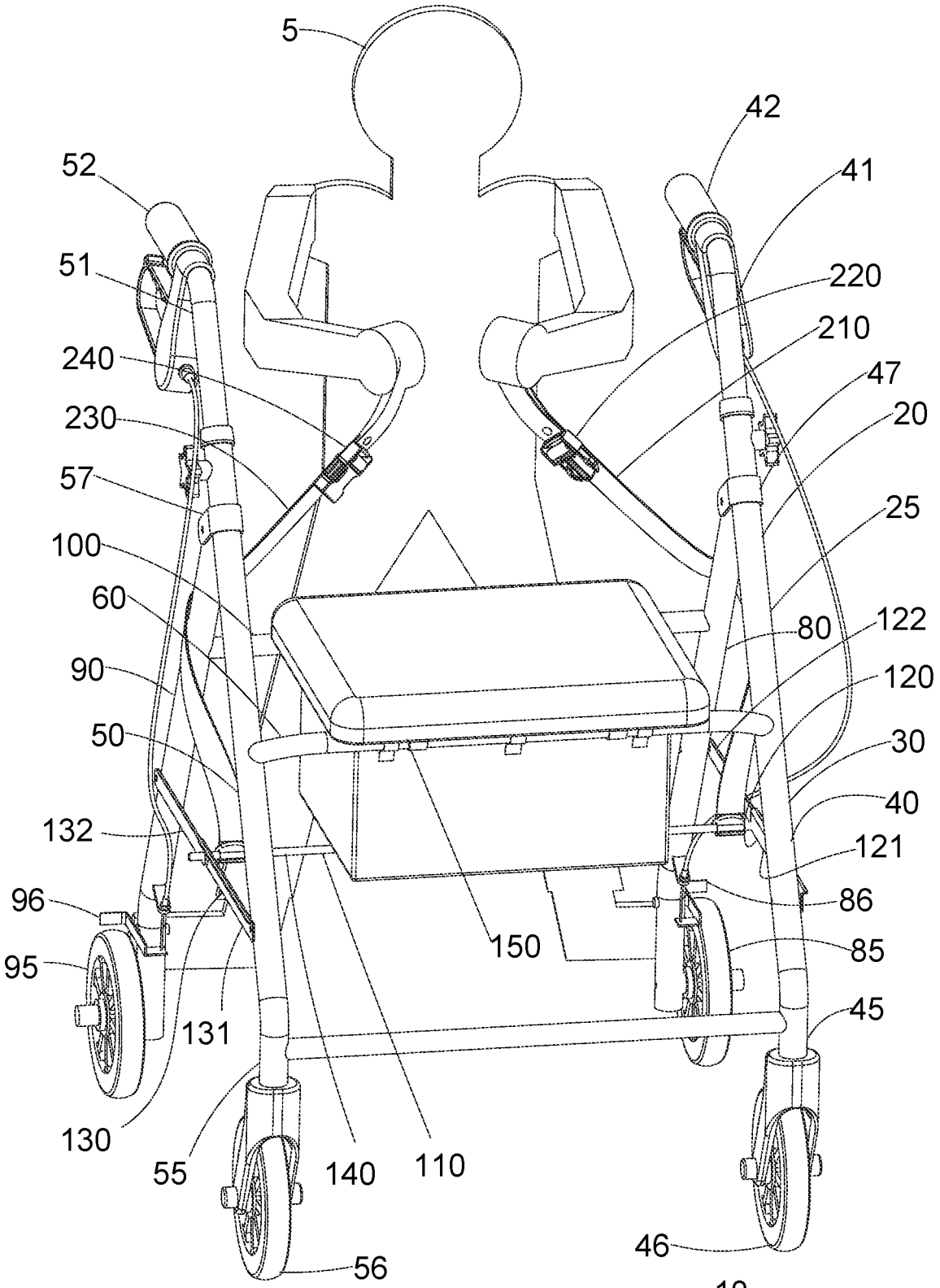
FIG. 6 is an end perspective view of a user engaging the straps which are wrapped around legs of the second section of the rollator body.

Several figures depict a preferred process of using the lashing assembly 200 to secure the rollator 20 in a folded position. In FIG. 6, it is seen that a user 5 is holding strap 210 after it has been wrapped around leg 80. The user 5 is also holding strap 230 after it has been wrapped around leg 90. The rollator 20 is still in the deployed or unfolded position in this figure and is resting on a horizontal surface such as a floor 10.

Figure 7:
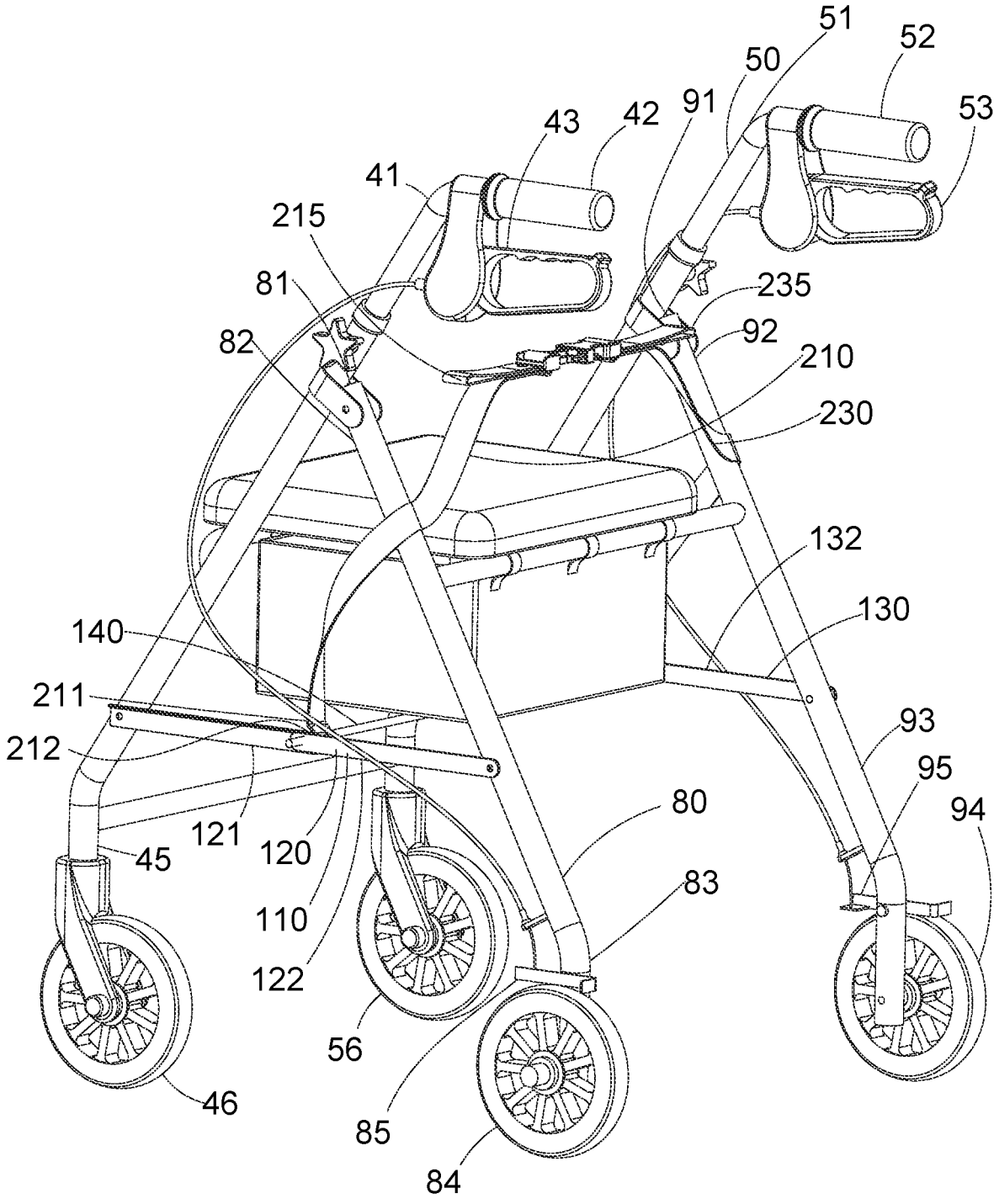
FIG. 7 is a rear perspective view showing the rollator with fasteners aligned in positions to be fastened.

FIG. 7 depicts the fasteners 220 and 240 being aligned so that they can be connected. Putting tension on the straps 210 and 230 causes the hinge assembly 110 to begin folding.

Figure 8:
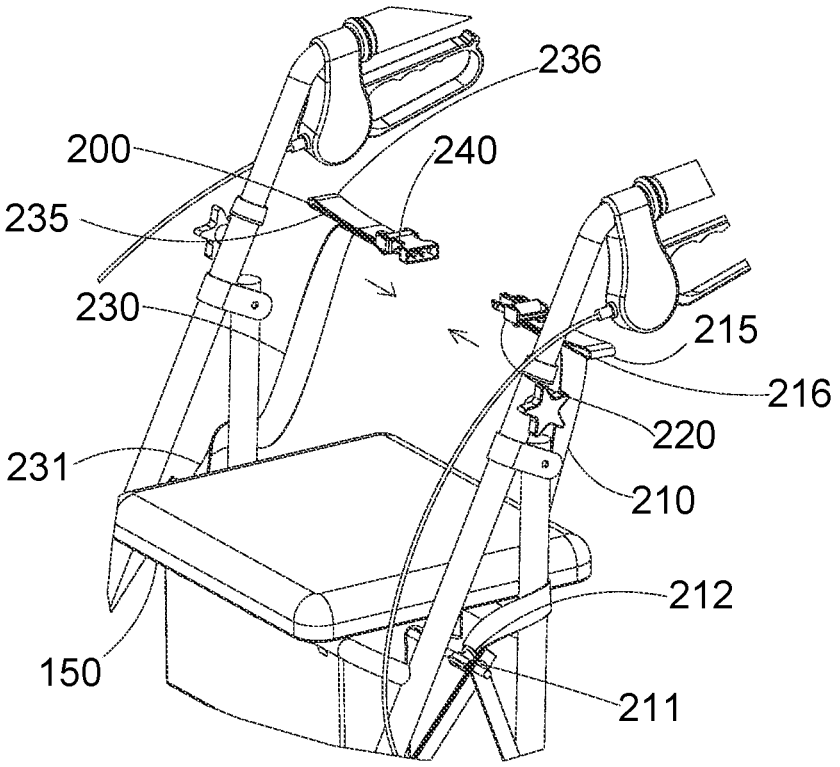
FIG. 8 shows the rollator in a folded position with the strap fasteners being aligned for connection.

FIG. 8 is similar to FIG. 7, but shows the rollator 20 in the folded position. The straps can be connected to each other or unconnected when using the straps 210 and 230 to aid in moving the rollator 20 to the folded and upright position. Further, use of the straps is not required to fold the rollator to the folded position. In this regard, the user can fold the rollator to the folded position before engaging the lashing assembly.

Figure 9:
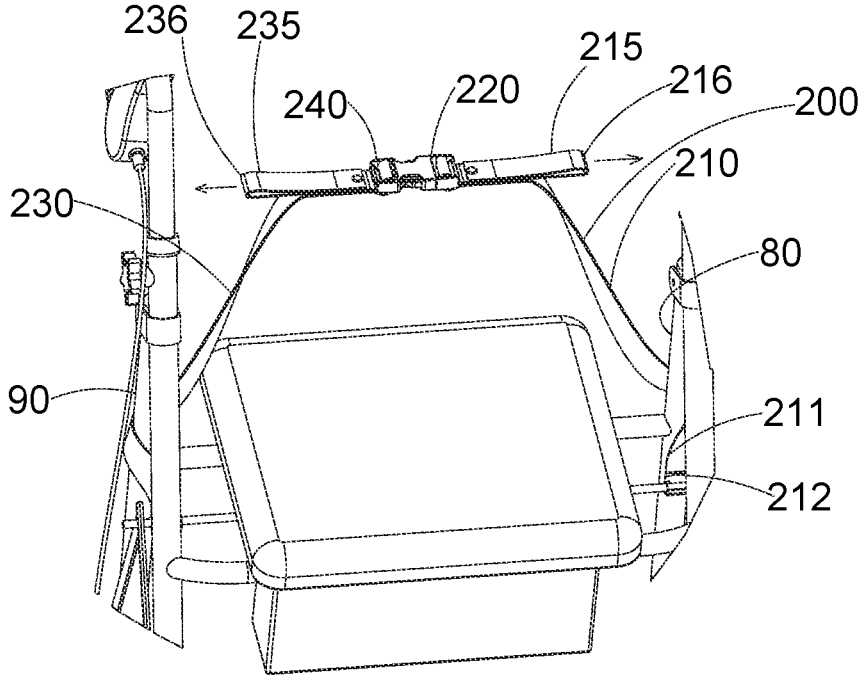
FIG. 9 is an end view showing the strap fasteners connected.
Figure 10:
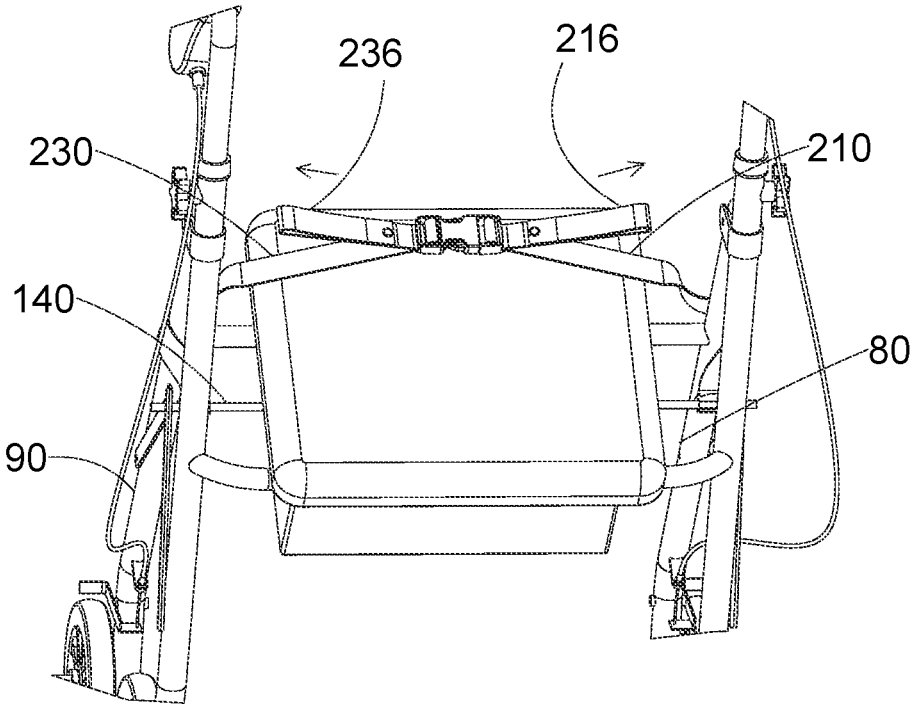
FIG. 10 is similar to FIG. 9 but shows the lashing assembly effective length being shortened as the handles are pulled apart.
Figure 11:
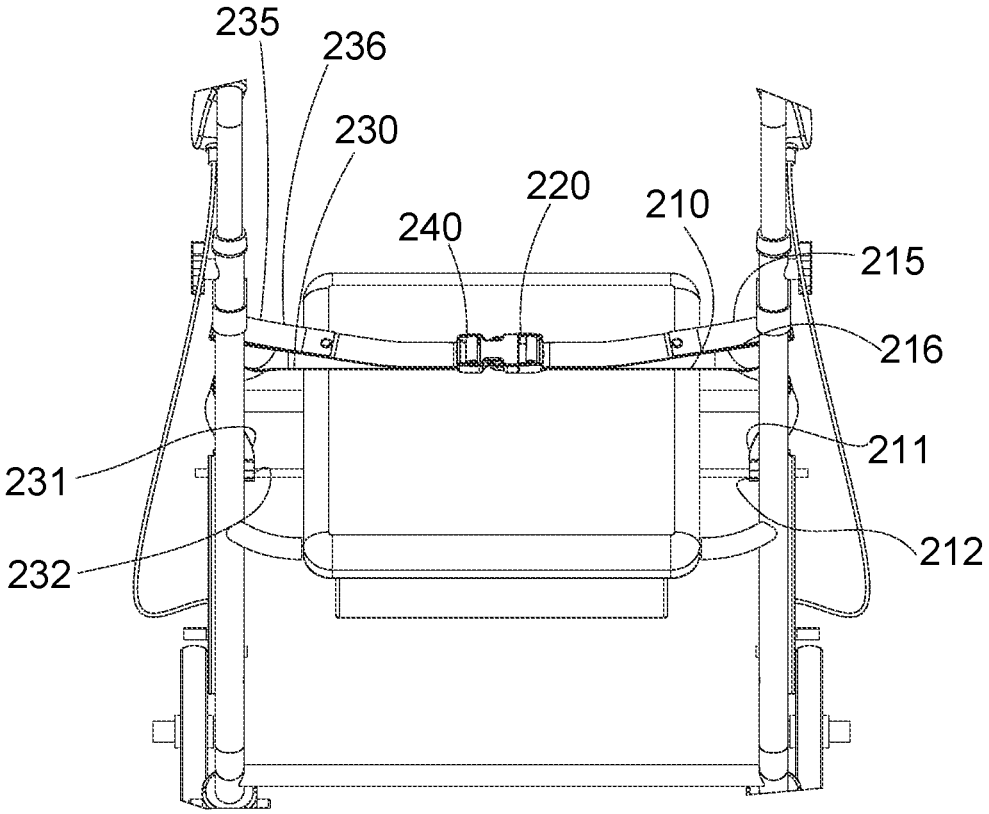
FIG. 11 is similar to FIG. 10 but shows the lashing assembly effective length being shortened (i.e. fully tightened upon rollator) to secure the rollator in an upright folded position.
Figure 12:
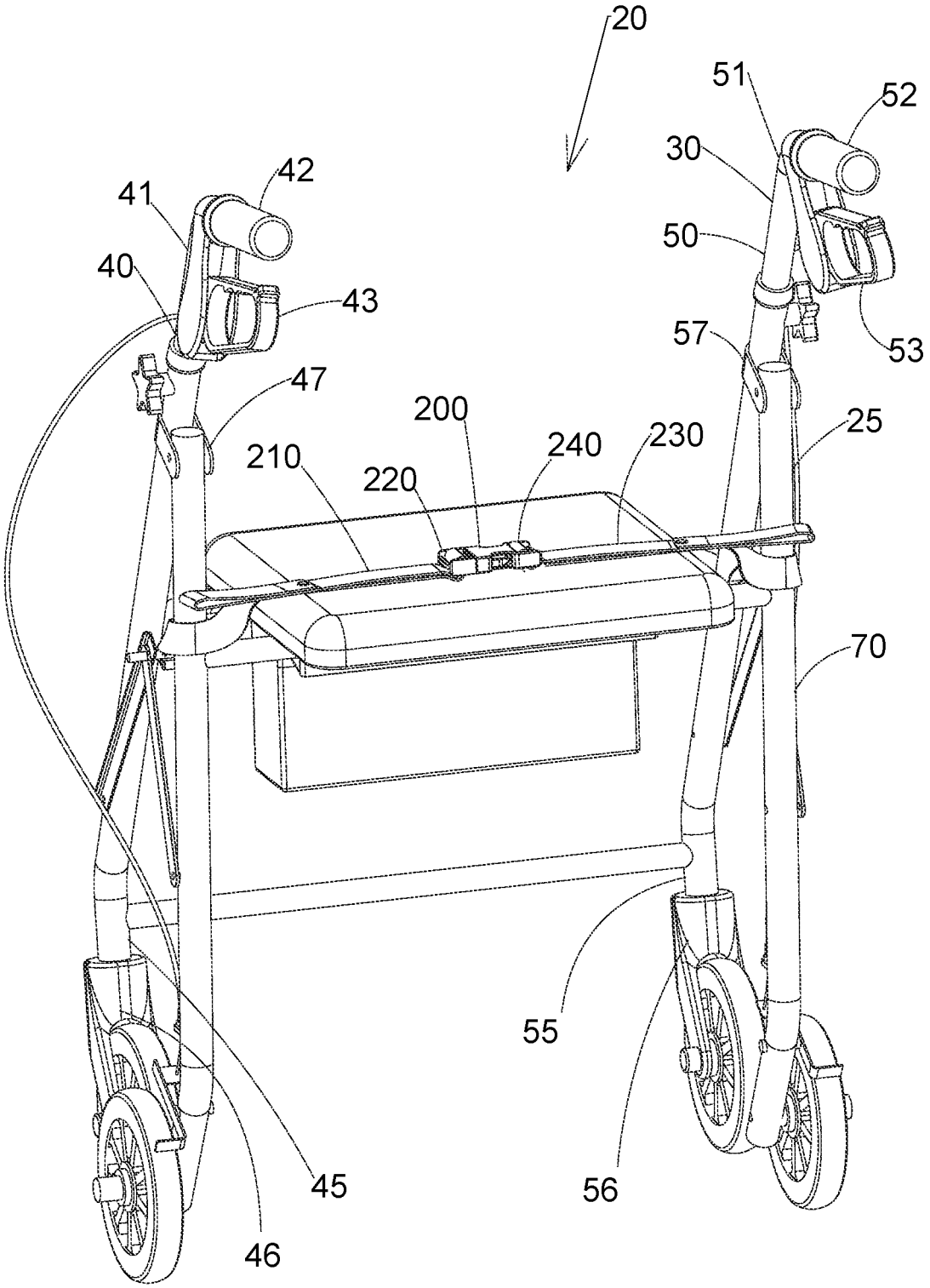
FIG. 12 is a rear view showing the lashing assembly fully tightened to secure the rollator in an upright folded position.
Figure 13:
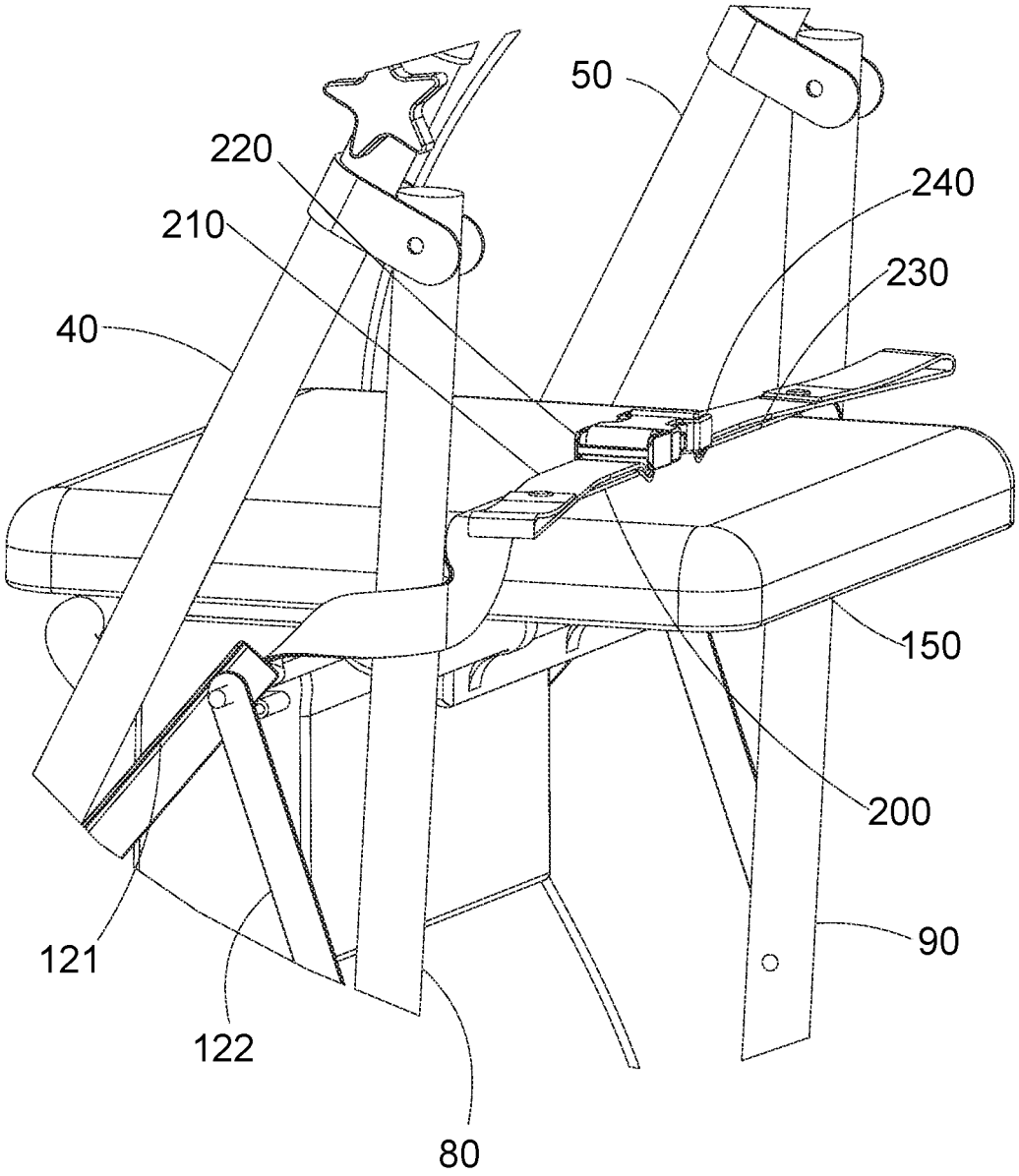
FIG. 13 is a close-up side view showing the lashing assembly securing the rollator in the folding position.

The fasteners 220 and 240 are connected to each other in FIG. 9. It is seen that the effective length of the lashing assembly 220 is too long in FIG. 9 to adequately secure the rollator in the folded position. FIG. 10 is an intermediate view wherein the effective length of the lashing assembly 200 is reduced after ends 215 and 235, respectively, of straps 210 and 230 are pulled in opposite directions while the fasteners 220 and 240 remain connected. The buckle maintains the effective length of the lashing assembly while the fasteners 220 and 240 are fastened together and the lashing assembly is under tension. The lashing assembly 200 is shown securing the rollator 20 in the folded position in FIGS. 11-13.

The rollator 20 is stable in the upright and folded position. The seat 150 is down and the fasteners 220 and 240 are preferably generally centered upon the seat. Strap 210 is connected to the crossbar 140, wraps around leg 80 and is atop seat 150. Strap 230 is connected to the opposite end of crossbar 140 wraps around leg 90 and is atop seat 150. The straps not only transfer a vertical force (by the user pulling the straps), but also imparts a force drawing the second section legs 80 and 90, respectively, and the crossbar 140 towards each other.

In the folded and locked position, the rollator can be transported in a safer manner as the risk of unintended unfolding is prevented. This is because the effective length is not easily elongated when the fasteners are fastened together and the lashing assembly is under tension.

Figure 14:
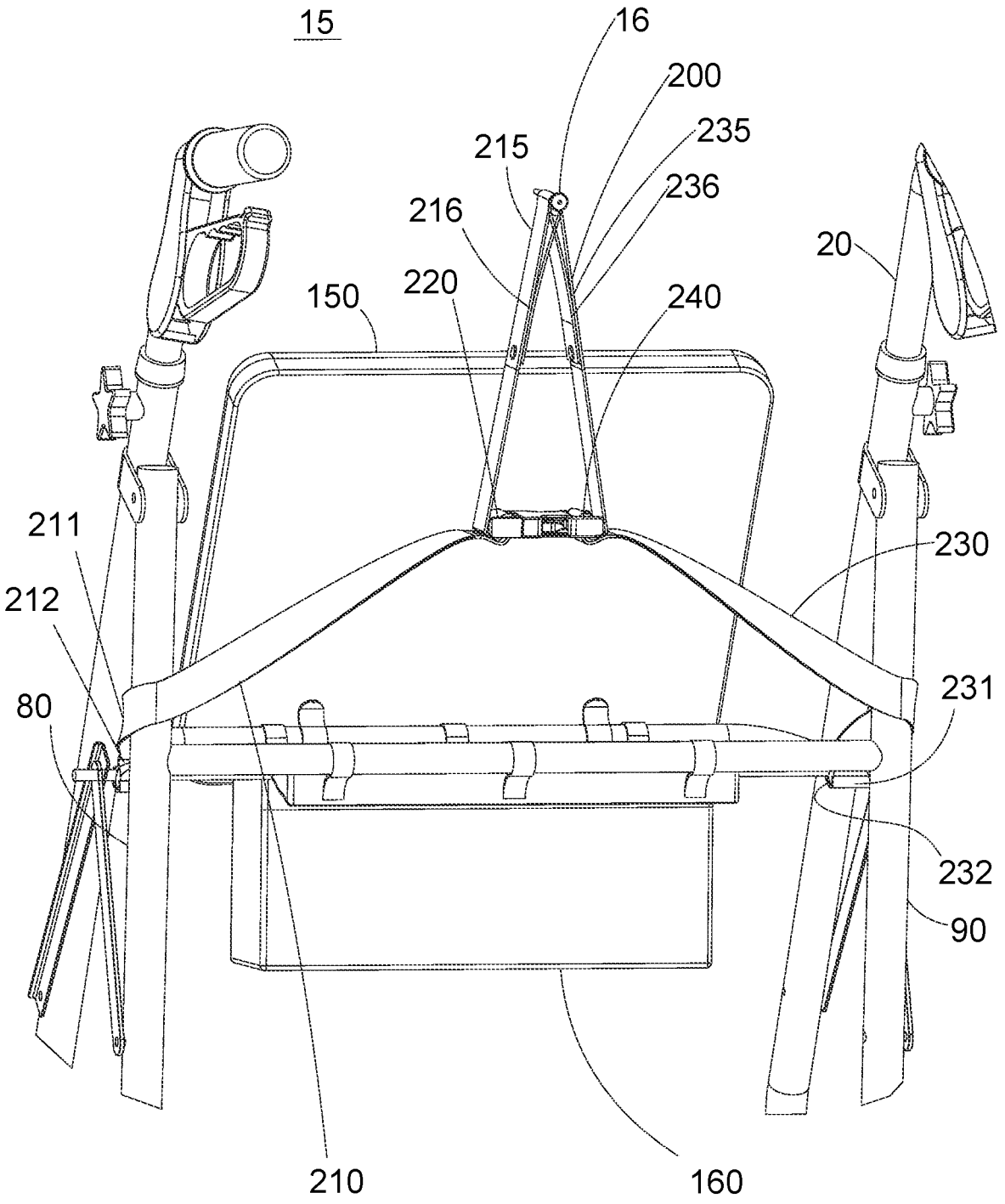
FIG. 14 is a rear partial view showing the rollator being suspended from a hanger.
Figure 15:
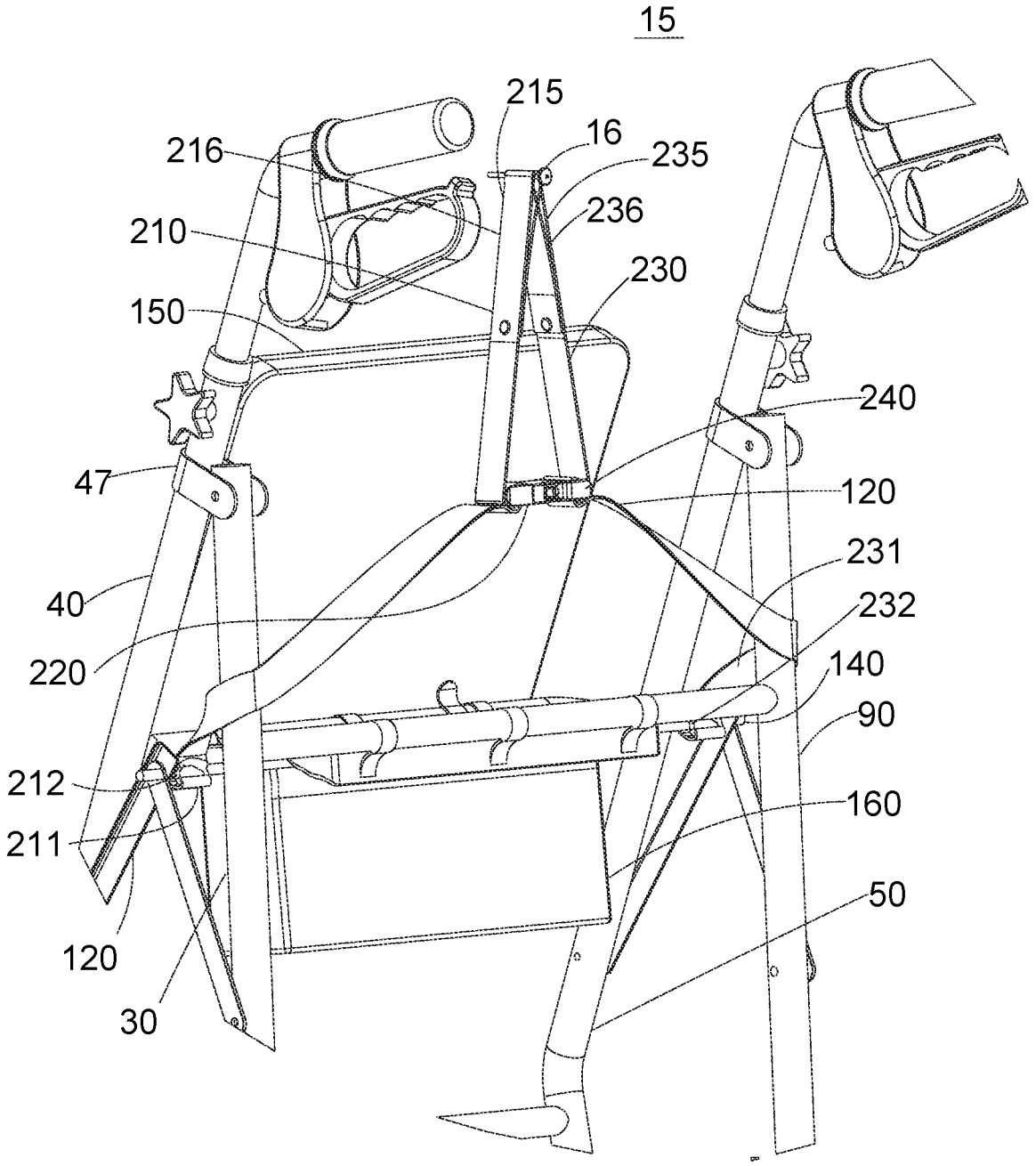
FIG. 15 is a partial side perspective view showing the rollator being suspended from a hanger.

Turning now to FIGS. 14 and 15, it is seen how the lashing assembly 200 is useful to store the rollator 20, in a secured folded position, on a hanger 16 such as a nail or hook on a vertical surface 15. To accomplish this, the seat 150 is tilted up, and the straps 210 and 230 are wrapped around the rear legs 80 and 90, respectively, and the fasteners 220 and 240 are connected. Then, the effective length of the lashing assembly 200 is shortened until the rollator is secured in the folded position. Lastly, the handles 216 and 236 are looped over the hanger 16. It is appreciated that the assembly 200 can also be used to store the rollator on a horizontal surface, such as a closet rod.

It is appreciated that the rollator can be unsecured from the folded position by disconnecting the prong fastener 220 and receiver fastener 240. This is accomplished by deforming the prongs and removing the prong fastener prongs from the receiver fastener cavities. Once tension is releases, the fasteners can easily be moved in either direction relative to the respective straps.

Figure 16:
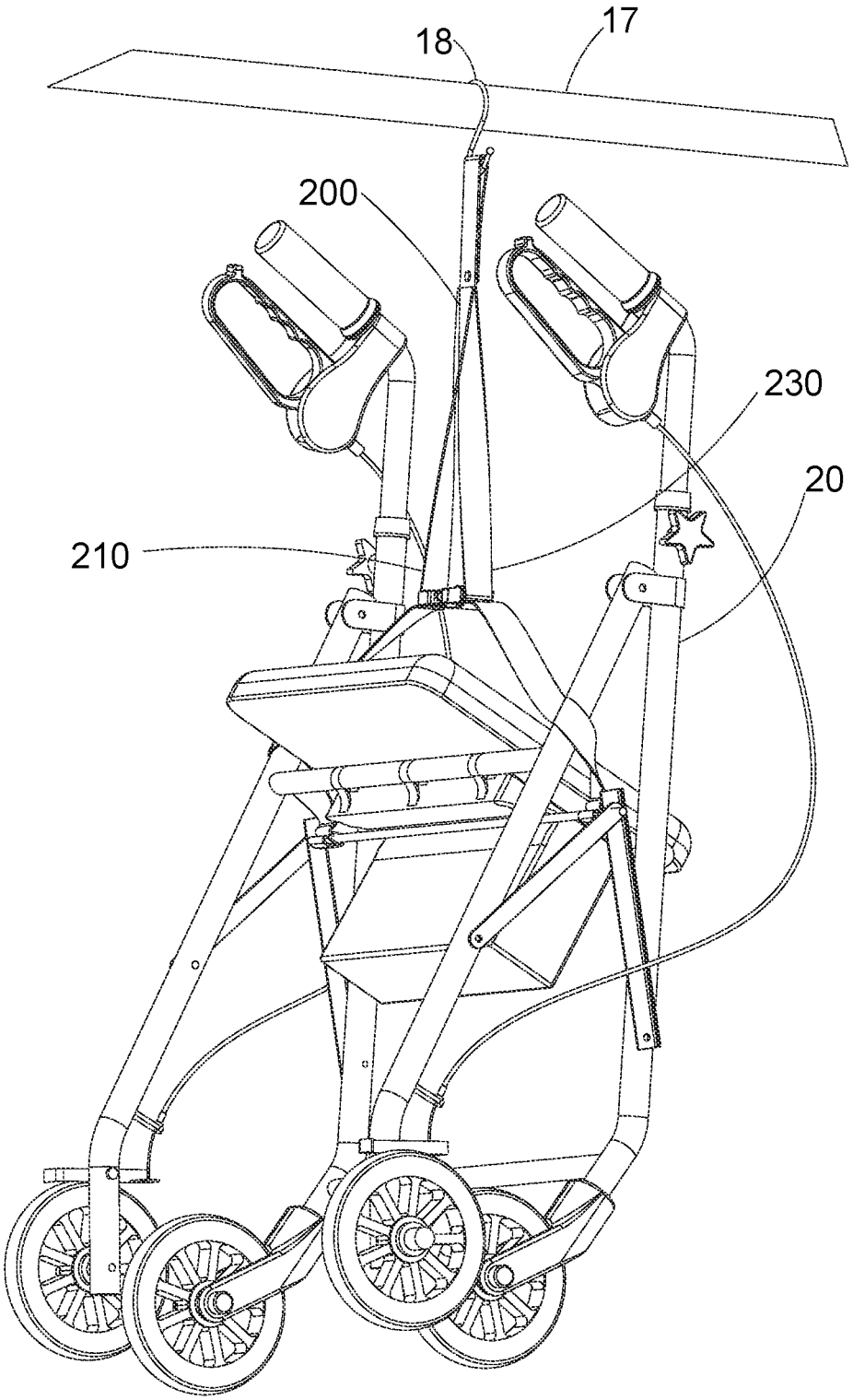
FIG. 16 is a perspective view showing the rollator suspended from a hook supported by a closet rod.

FIG. 16 shows how the lashing assembly 200 is useful to store the rollator from a hanger 18 (such as a hook) supported from a horizontal element 17 (such as a closet rod).

Figure 17:
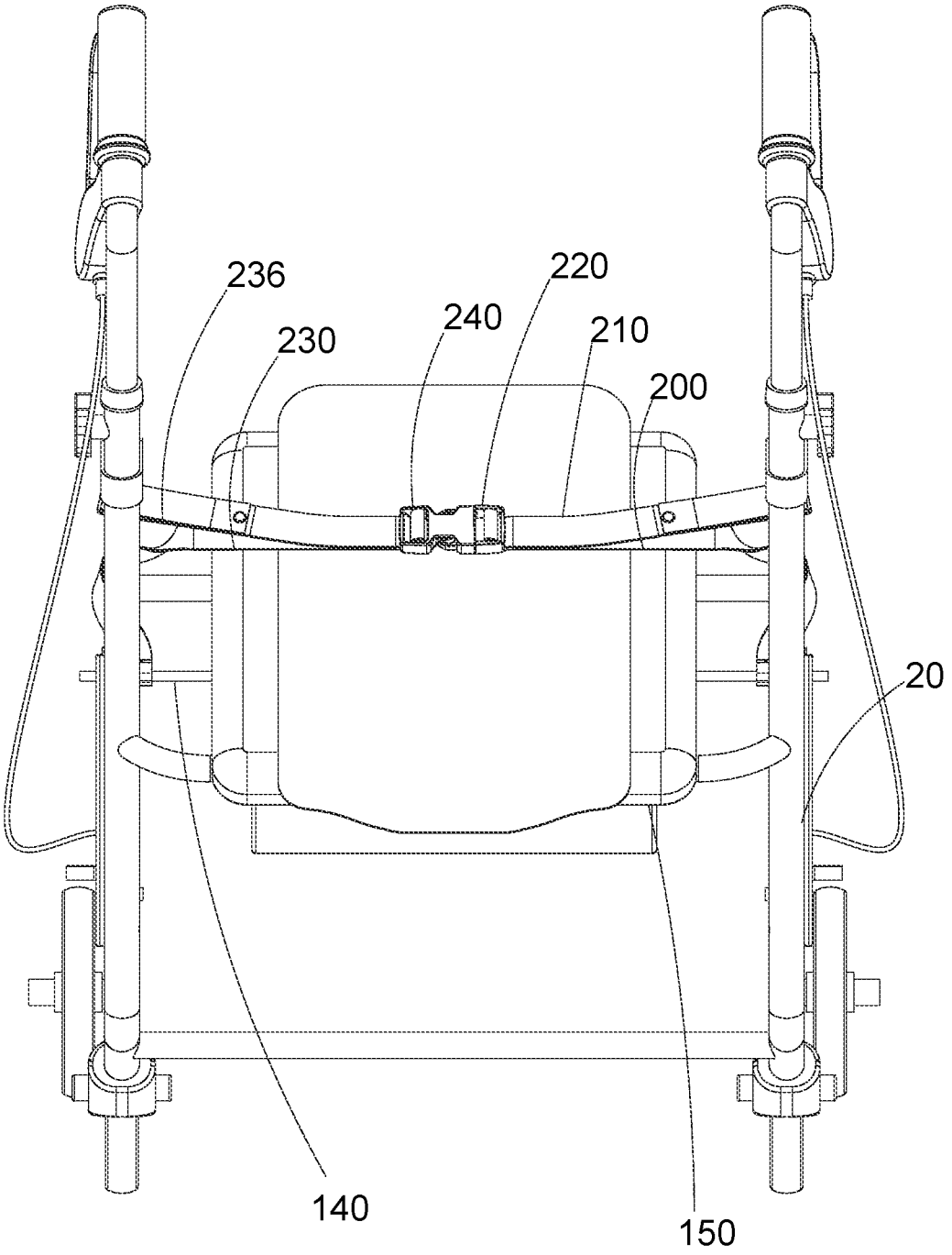
FIG. 17 is a top view showing the lashing assembly used to secure a load upon the seat.

Turning now to FIG. 17, it is seen how the lashing assembly 200 is useful to secure a load atop the seat 150. This is accomplished by placing a load on the seat 150 (weight preferably centered on the seat), connecting the fasteners 220 and 240 and shortening the effective length of the lashing assembly. There is no need to wrap the straps around the legs to secure the load. Instead, directly placing the straps atop the load, centered on the seat 150 helps keep the center of gravity over the crossbar 140 to prevent tipping.

Figure 18:
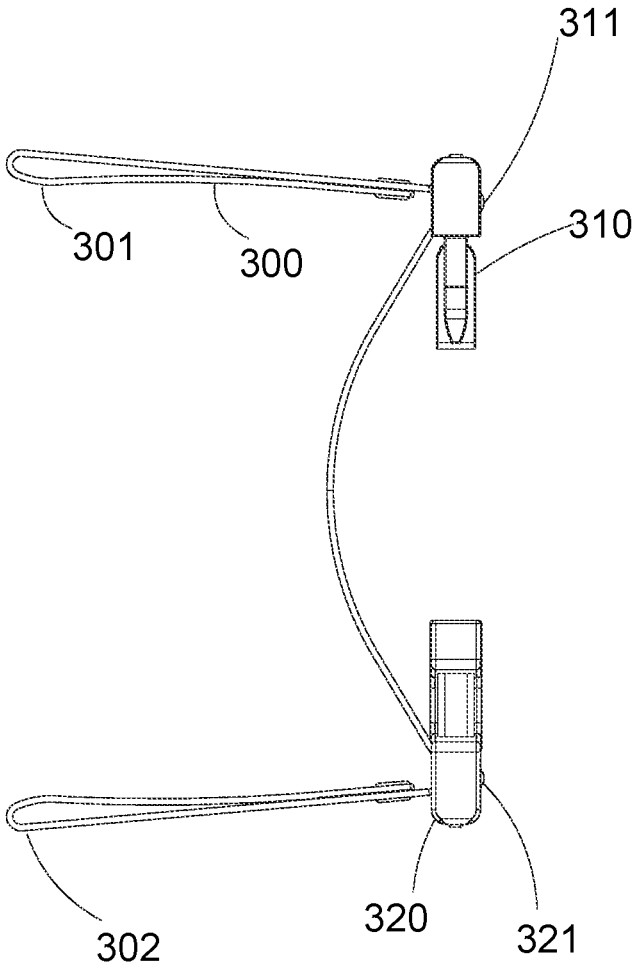
FIG. 18 is an isolation side view of an embodiment of a brake lock.
Figure 18A:
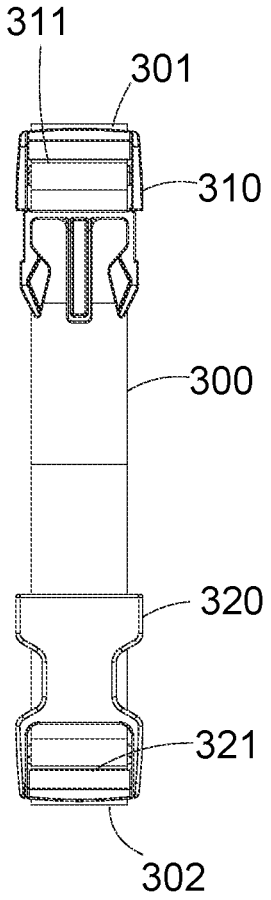
FIG. 18A is an end view of the embodiment shown in FIG. 18.
Figure 19:
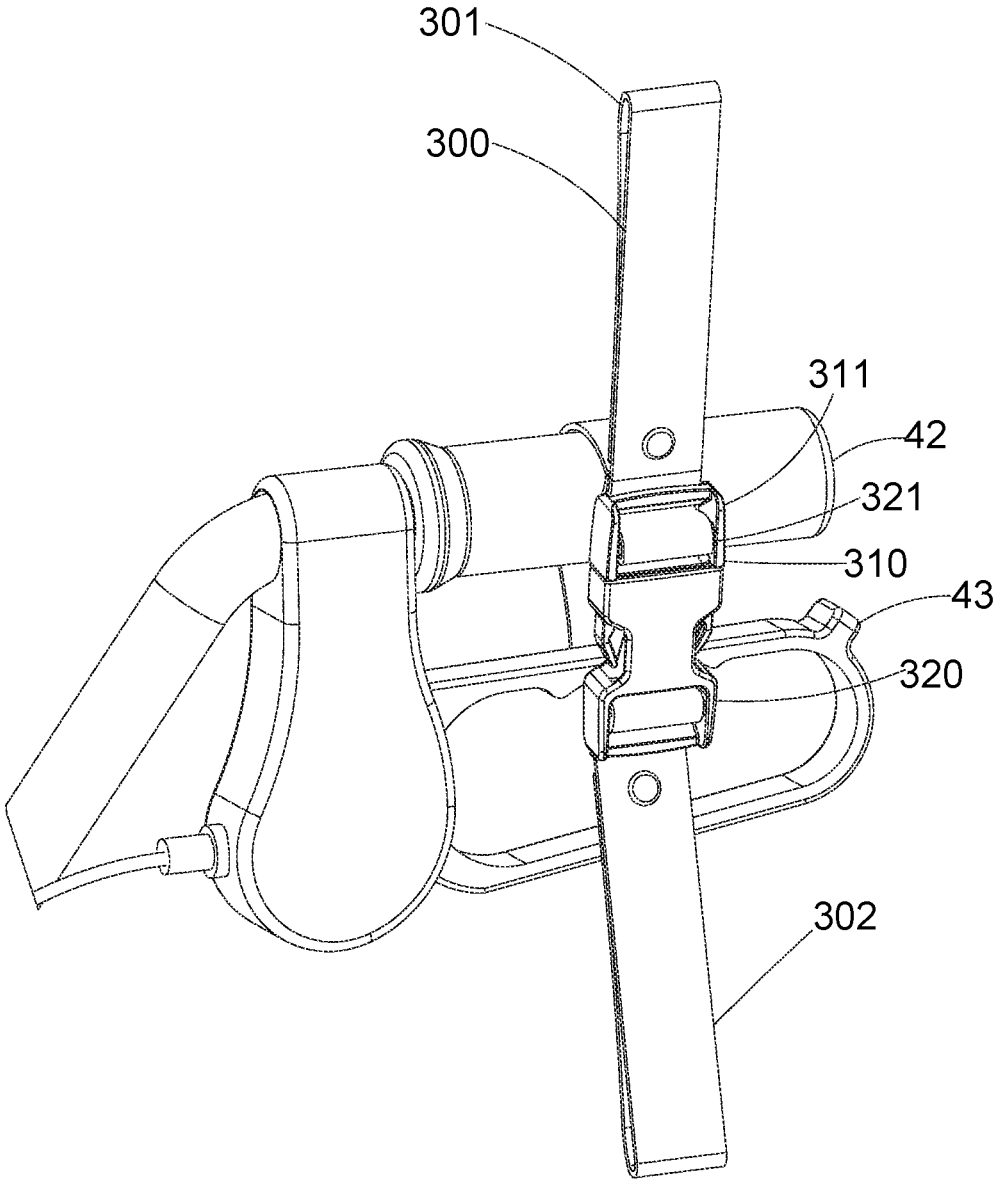
FIG. 19 is a perspective view showing the brake lock used to lock a brake lever in the locked position relative to a handle.

A preferred embodiment of a brake strap 300 is illustrated in FIGS. 18 and 19. The break strap 300 has ends 301 and 302. A prong fastener 310 with a slot with bar 311, and a receiver fastener 320 with a slot with bar 321 is provided The strap passes through slots with bars 311 and 321, as seen in FIG. 18. The fasteners can be removably secured together. The brake strap 300 can lock a brake lever in the locked position by placing the strap 300 around the grip 42 and brake lever 43, connecting the fasteners 310 and 320, and shorting the effective length of the brake strap (length of connected fasteners plus length of strap between connected fasteners) until the brake strap hold the brake lever in the locked position. The brake strap can be released by disconnecting the fasteners 310 and 320. The strap 300 is illustrated to be about 1 inch in width. Yet, it is appreciated that other widths may be used without departing from the broad aspects of the present invention.

Figure 20:
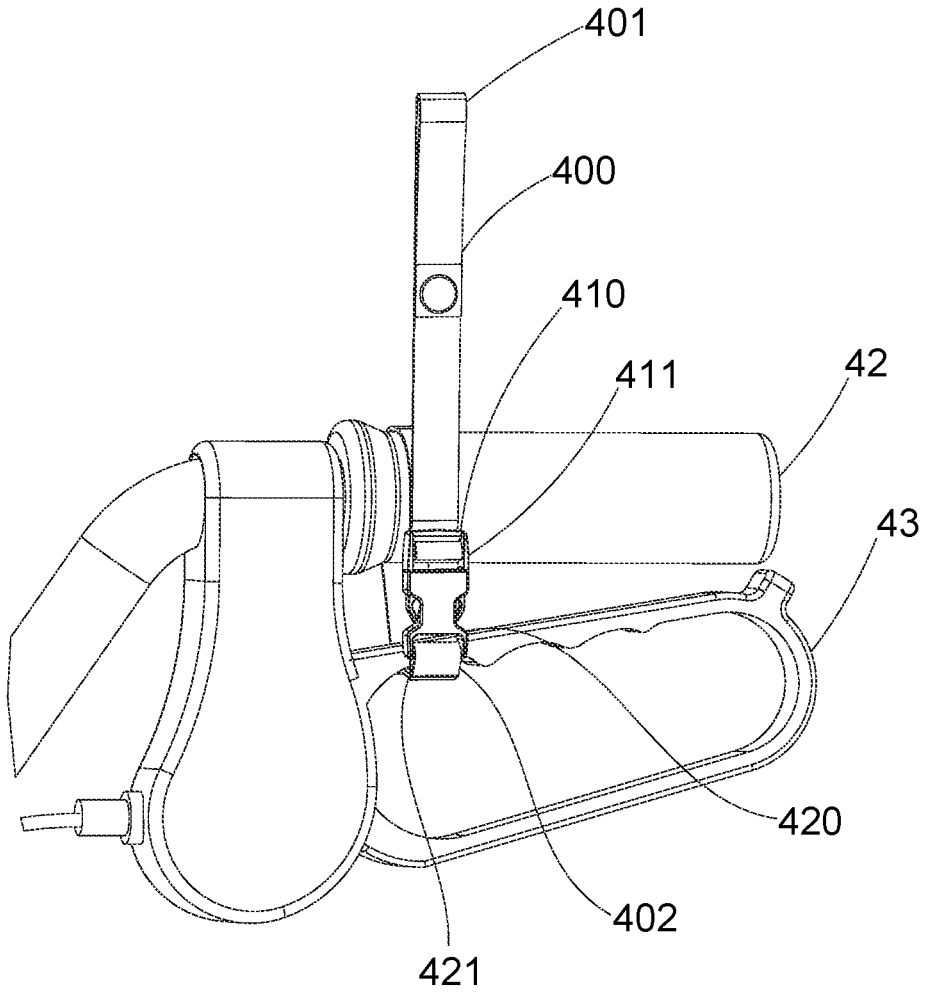
FIG. 20 is a perspective view of an alternative embodiment of a brake lock.

Another preferred embodiment of a brake strap 400 is illustrated in FIG. 20. The break strap 400 has ends 401 and 402. A prong fastener 410 with a slot with bar 411, and a receiver fastener 420 with a slot with bar 421 is provided The strap passes through the slot with bars 311 between the ends 401 and 402, and end 402 is wrapped around the bar of the bar and slot 421. The fasteners can be removably secured together. The brake strap 400 can lock a brake lever in the locked position by placing the strap 400 around the grip 42 and brake lever 43, connecting the fasteners 410 and 420, and shorting the effective length of the brake strap (length of connected fasteners plus length of strap between connected fasteners) by pulling more of the strap through bar and slot 411 until the brake strap hold the brake lever in the locked position. The brake strap can be released by disconnecting the fasteners 410 and 420. The 400 is illustrated to be about ½ inch in width. Yet, it is appreciated that other widths may be used without departing from the broad aspects of the present invention.

Figure 21:
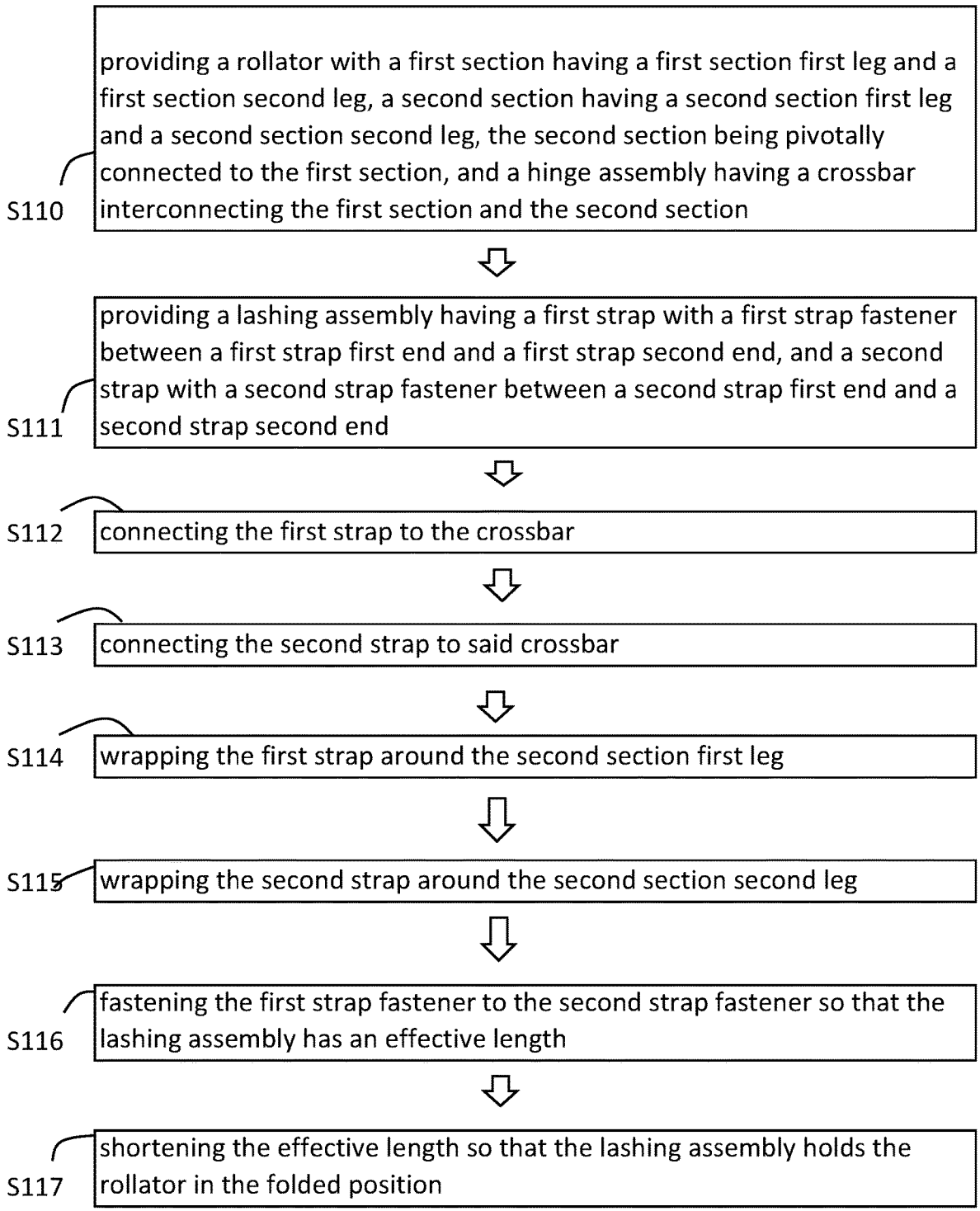
FIG. 21 is a flow chart showing a method of securing a rollator in a folded position.

Turning now to FIG. 21, it is seen that a method of securing a rollator in a folded position is illustrated. The method comprises the steps: providing a rollator with a first section having a first section first leg and a first section second leg, a second section having a second section first leg and a second section second leg, the second section being pivotally connected to the first section, and a hinge assembly having a crossbar interconnecting the first section and the second section (Step S110); providing a lashing assembly having a first strap with a first strap fastener between a first strap first end and a first strap second end, and a second strap with a second strap fastener between a second strap first end and a second strap second end (Step S111); connecting the first strap to the crossbar (Step S112); connecting the second strap to said crossbar (Step S113); wrapping the first strap around the second section first leg (Step S114); wrapping the second strap around the second section second leg (Step S115); fastening the first strap fastener to the second strap fastener so that the lashing assembly has an effective length (Step S116); and shortening the effective length so that the lashing assembly holds the rollator in the folded position (Step S117). It is appreciated that other steps could be included without departing from the broad aspects of the present invention.

Thus, it is apparent that there has been provided, in accordance with the invention, a rollator with lashing assembly and methods of use thereof that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A rollator comprising:
a first section;
a second section;
a hinge assembly having a crossbar; and
a lashing assembly, said lashing assembly comprising:
a first strap connected to said crossbar and having a first strap fastener; and
a second strap connected to said crossbar and having a second strap fastener,
wherein said first strap fastener is selectably connectable to said second strap fastener so that said lashing assembly has an effective length, said effective length being adjustable.

2. The rollator of claim 1 wherein:
said first strap has a first strap first end and a first strap second end;
said second strap has a second strap first end and a second strap second end;
said lashing assembly has a first ring at said first strap first end; and
said lashing assembly has a second ring at said second strap first end.

3. The rollator of claim 2 wherein:
said first strap has a first strap handle at said first strap second end; and
said second strap has a second strap handle at said second strap second end.

4. The rollator of claim 3 wherein said first strap handle is a first strap loop and said second strap handle is a second strap loop.

5. The rollator of claim 1 wherein:
said first strap has a first strap first end and a first strap second end;
said second strap has a second strap first end and a second strap second end;
said first strap fastener is between said first strap first end and said first strap second end; and
said second strap fastener is between said second strap first end and said second strap second end.

6. The rollator of claim 5 wherein:
said first strap fastener is a prong fastener; and
said second strap fastener is a receiver fastener.

7. The rollator of claim 5 wherein said first strap and said second strap are each selectably wrapped around said second section before being selectably fastened together.

8. The rollator of claim 7 wherein:
said first section is pivotally connected to said second section; and shortening of said effective length when said first fastener is connected to said second fastener causes said first section to pivot towards said second section.

9. The rollator of claim 7 wherein said lashing assembly selectably and releasably locks said rollator in a folded position when said effective length is shortened to keep said second section adjacent to said first section.

10. The rollator of claim 1 further comprising a brake lock.

11. A lashing assembly for use with a rollator having a first section having a first section first leg and a first section second leg, the rollator further having a second section having a second section first leg and a second section second leg, said second section being pivotally connected to said first section, and the rollator further having a hinge assembly having a crossbar and interconnecting said first section and said second section, said lashing assembly comprising:

a first strap with a first strap first end and a first strap second end, and a first strap fastener between said first strap first end and said first strap second end, said first strap being selectably connectable to the crossbar; and a second strap with a second strap first end and a second strap second end, and a second strap fastener between said second strap first end and said second strap second end, said second strap being selectably connectable to the crossbar, wherein said first strap fastener is selectably connectable to said second strap fastener so that said lashing assembly has an effective length, said effective length being adjustable.

12. The lashing assembly of claim 11 wherein:

said lashing assembly has a first ring at said first strap first end; and said lashing assembly has a second ring at said second strap first end.

13. The lashing assembly of claim 12 wherein:

said first strap has a first strap handle at said first strap second end; and said second strap has a second strap handle at said second strap second end.

14. The lashing assembly of claim 13 wherein:

said first strap fastener is a prong fastener; and said second strap fastener is a receiver fastener.

15. The lashing assembly of claim 13 wherein:

said first strap and said second strap are each selectably wrapped around the second section before being selectably fastened together;

shortening of said effective length of said lashing assembly by a selected amount selectably and releasably locks the rollator in a folded position.

16. A method of securing a rollator in a folded position comprising the steps:

providing a rollator with a first section having a first section first leg and a first section second leg, a second section having a second section first leg and a second section second leg, the second section being pivotally connected to the first section, and a hinge assembly having a crossbar and interconnecting the first section and the second section;

providing a lashing assembly having a first strap with a first strap fastener between a first strap first end and a first strap second end, and a second strap with a second strap fastener between a second strap first end and a second strap second end;

connecting the first strap to the crossbar;

connecting the second strap to said crossbar;

wrapping the first strap around the second section first leg;

wrapping the second strap around the second section second leg;

fastening the first strap fastener to the second strap fastener so that the lashing assembly has an effective length; and shortening the effective length so that the lashing assembly holds the rollator in the folded position.

17. The method of claim 16 wherein the step of providing a lashing assembly further comprises the step of providing a first strap fastener that is a prong fastener and a second strap fastener that is a receiver fastener.

18. The method of claim 16 wherein the step of providing a lashing assembly further comprises the step of providing a first strap ring at the first strap first end and a second strap ring at the second strap first end.

19. The method of claim 16 wherein the step of providing a lashing assembly further comprises the step of providing a first strap handle at the first strap second end and a second strap handle at the second strap second end.

20. The method of claim 16, before the step shortening the effective length so that the lashing assembly holds the rollator in the folded position, the method comprising the step of shortening the effective length to assist in pivoting the second section towards the first section.

* * * * *